US007818829B2

(12) United States Patent
Moretto

(10) Patent No.: US 7,818,829 B2
(45) Date of Patent: Oct. 26, 2010

(54) JET FOR A SHOWER CUBICLE

(75) Inventor: Alessandro Moretto, Pordenone (IT)

(73) Assignee: Ideal Standard International BVBA (BE)

( * ) Notice: Subject to any disclaimer, the term of this patent is extended or adjusted under 35 U.S.C. 154(b) by 1030 days.

(21) Appl. No.: 11/589,483

(22) Filed: Oct. 30, 2006

(65) Prior Publication Data

US 2007/0067904 A1 Mar. 29, 2007

(30) Foreign Application Priority Data

May 19, 2004 (IT) ..... RE2004A0056

(51) Int. Cl.
*A47K 3/022* (2006.01)

(52) U.S. Cl. ..... 4/615; 4/541.6; 4/541.5; 4/541.1; 239/469

(58) Field of Classification Search ..... 4/615, 4/541.1, 541.5, 541.6; 239/468, 469, 470
See application file for complete search history.

(56) References Cited

U.S. PATENT DOCUMENTS 3,485,451 A * 12/1969 Gore et al. ..... 239/383
3,567,130 A * 3/1971 Holt ..... 239/326
4,068,801 A * 1/1978 Leutheuser ..... 239/381
4,125,226 A * 11/1978 Nieuwkamp ..... 239/468
4,681,263 A * 7/1987 Cockman ..... 239/391
5,271,561 A * 12/1993 Tobias et al. ..... 4/541.6
5,344,079 A * 9/1994 Tasaki et al. ..... 239/498
5,360,166 A * 11/1994 Nogi et al. ..... 239/404
5,386,598 A * 2/1995 Mersmann ..... 4/541.4
5,495,627 A * 3/1996 Leaverton et al. ..... 4/541.6
5,587,023 A * 12/1996 Booth ..... 4/541.6
6,889,916 B2 * 5/2005 Loyd et al. ..... 4/541.6
6,991,182 B2 * 1/2006 Chen ..... 4/541.6
7,131,604 B2 * 11/2006 Enomura ..... 239/461
2003/0196260 A1 * 10/2003 Pettenon ..... 4/541.6

* cited by examiner

*Primary Examiner*—Khoa D Huynh
(74) *Attorney, Agent, or Firm*—Frank M. Gasparo

(57) ABSTRACT

A jet for a shower cubicle which is suitable for being applied to a side wall of the shower cubicle is described as having an end body for supplying water to the shower cubicle having a through channel for the water. The jet also includes at least one supply duct to supply pressurised water to the through channel and out a nozzle having an ejection hole to produce a water spray inside the cubicle. for the water communicating with the through channel of the end body. The nozzle is removable from the end body, allowing it to be replaced when the end body is fixed to the wall of the cubicle.

3 Claims, 2 Drawing Sheets

JET FOR A SHOWER CUBICLE

The present invention refers to a jet for a shower cubicle in accordance with the preamble of claim 1.

More specifically, the present invention refers to jets for a shower cubicle of the type with a nebulizing spray and generally arranged on one or more vertical rows along the side wall of the shower cubicle.

As known, shower cubicles of this type achieve ever greater success with the public.

This has led to the widening of the commercial range from the industry of the field, in particular the possibility of having jets with nozzles capable of ejecting water with a nebulizing or filiform spray according to the wishes of the user.

Unfortunately, the jets of the prior art, after installation, do not lend themselves to adjustment of the ejector nozzle in order to satisfy possible changed tastes of the user, for example, the change in type of water spray from nebulizing to filiform and vice-versa.

Indeed, should one wish to change the type of water spray ejected from the nozzle the intervention of a specialized expert is often necessary. Moreover, intervention cannot be carried out without accessing the back of the wall of the shower cubicle with consequent further time consumption.

Therefore, the requirement of having a jet for a shower cubicle that allows easy replacement of the ejection nozzle, as well as that allows the type of spray coming out from the nozzle to be changed with simple operations is highly desirable.

The purpose of the present invention is that of providing a jet for a shower cubicle having structural and functional characteristics such as to satisfy the aforementioned requirements and at the same time to avoid the aforementioned drawbacks with reference to the prior art, with a simple and rational solution.

Such a purpose is accomplished through a jet for a shower cubicle in accordance with claim 1.

The dependent claims outline preferred and particularly advantageous embodiments of the jet for a shower cubicle according to the invention.

Further characteristics and advantages of the invention shall become clear from reading the following description provided as an example and not for limiting purposes, with the help of the figures illustrated in the attached tables, in which.

Figure 1:
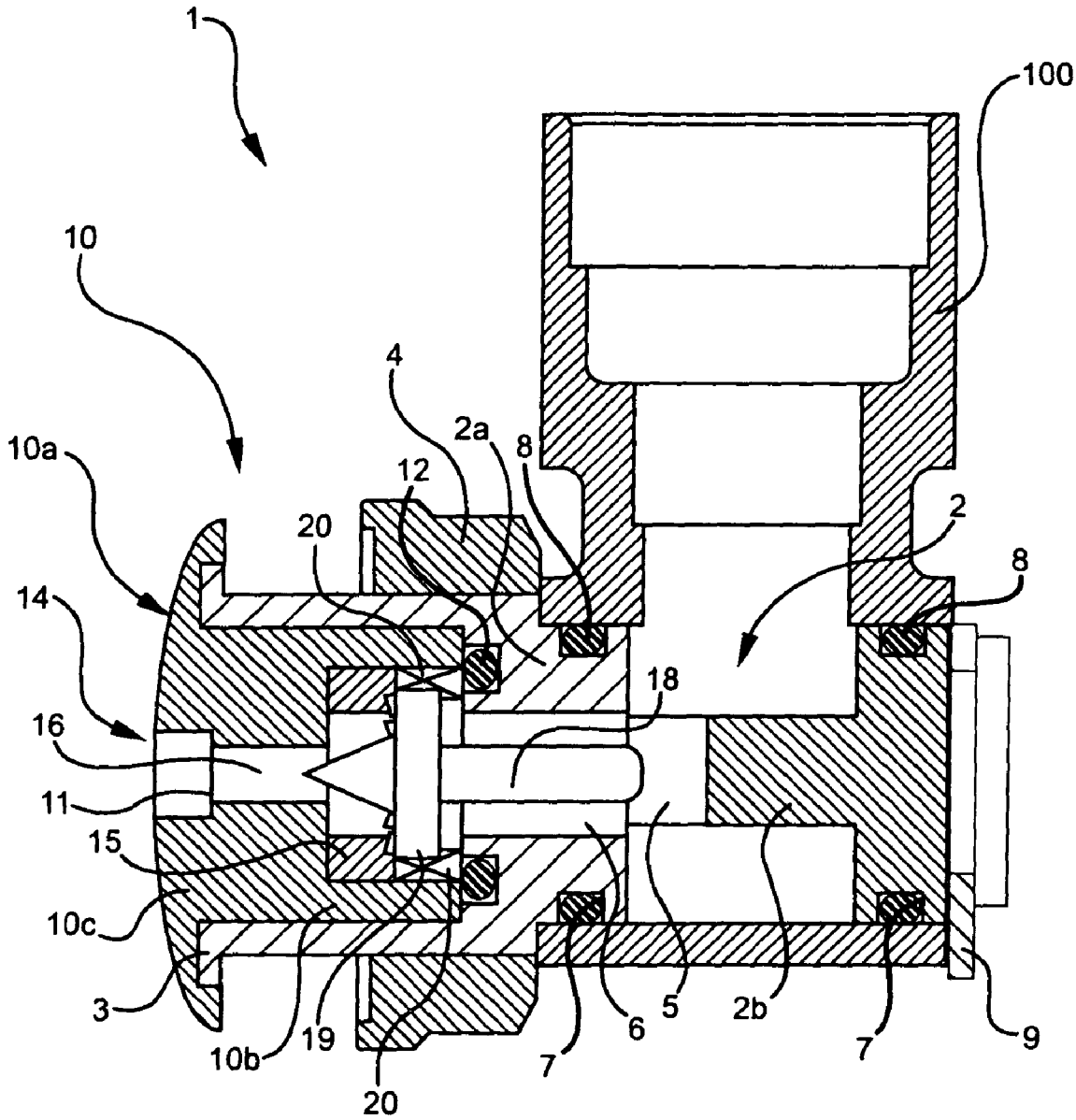
FIG. 1 shows a section view of a jet for a shower cubicle in accordance with the present invention.
Figure 2:
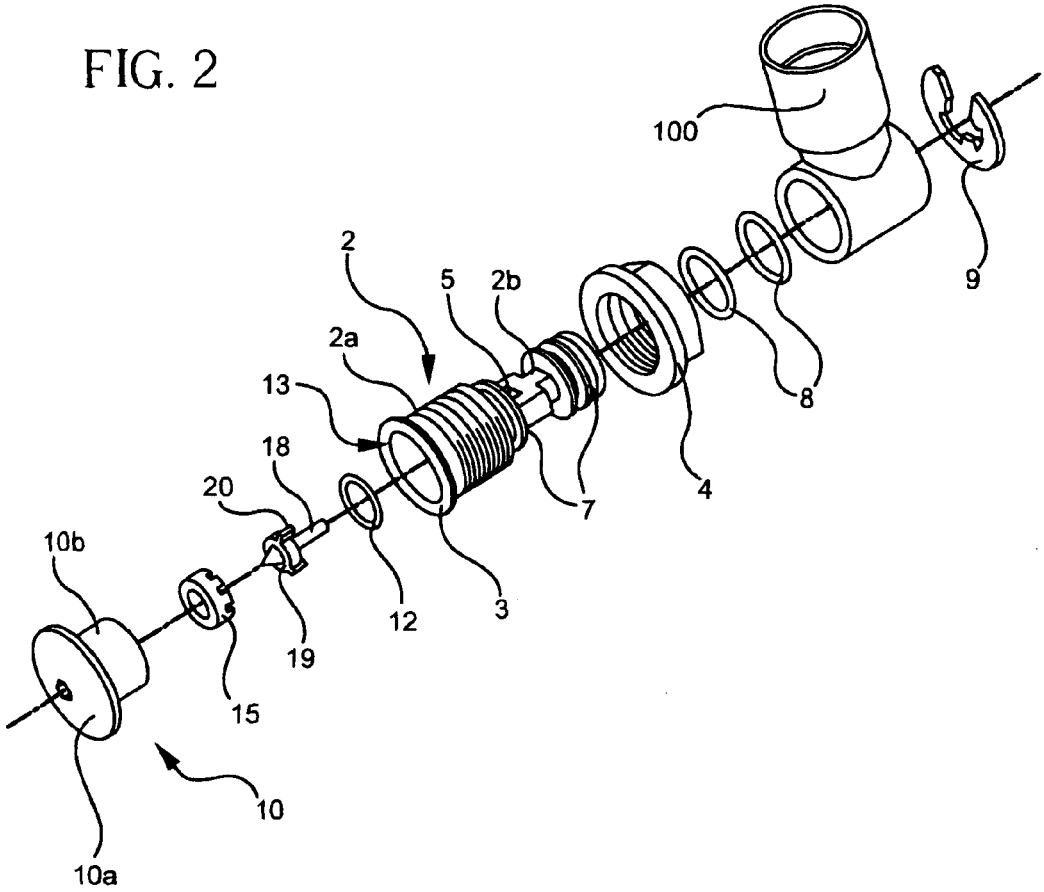
FIG. 2 shows an exploded view of the jet of FIG. 1.

With reference to the aforementioned figures, a jet for a shower cubicle in accordance with the present invention is globally indicated with 1.

The jet 1 comprises an end body 2 for supplying water to the shower cubicle, not illustrated.

The end body 2 has a substantially cylindrical configuration and is provided at one end with an annular rim 3 slightly projecting radially.

In the illustrated example, the end body 2 has two portions of substantially the same length formed in a single piece through injection moulding: a first portion 2*a* facing towards the annular rim 3 has an external threading to allow easy fastening to the wall of the cubicle through a ring nut 4 and a second portion 2*b* suitably shaped to receive a fitting 100, in the example, a one-way fitting, for the water supply ducts, not illustrated.

The end body 2 is inserted into an inlet hole, with the same diameter as the end body 2, made on the side wall of the shower cubicle until the annular rim 3 goes into abutment against the side wall of the cubicle so as to be entirely facing towards the outside of the cubicle that is, in practice, the part invisible to the user.

The ring nut 4 is screwed onto the external threading of the end body 2 so as to prevent the displacement of the end body 2 with respect to the wall of the cubicle.

The second portion 2*b* of the end body 2 is provided with a through opening 5 for the water coming from the supply ducts. Said opening 5 communicates with a through Channel 6 formed inside the first portion 2*a* of the end body 2 to as to direct the water inside the shower cubicle.

In order to ease the assembly of the jet 1, the fitting 100 is of the snap-engagement type. To avoid possible leaks, since the water has a pressure of about 3 bar, close to the outer end of the second portion 2*b* of the end body 2 and between the first portion 2*a* and second portion 2*b* of the end body 2 two grooves 7 are formed along the outer perimeter suitable for forming seats for receiving respective O-rings 8. In addition, it is possible to foresee the use of an outer Seeger 9 arranged at the outer end of the second portion 2*b* of the end body 2 suitable for ensuring the locking of the fitting 100 according to the prior art.

Operatively, the fitting 100 is associated with the end body 2 after the ring nut 4 has been screwed onto the first portion 2*a* of the end body 2.

In accordance with a preferred embodiment of the present invention, the first portion 2*a* of the end body 2 can be associated with a removable nozzle 10 provided with a water ejection hole 11.

The ejection hole 11 is in communication with the through channel 6 so that the pressurised water coming from the supply duct, crossing the opening 5 of the second portion 2*b*, passes into the through channel 6 to then be ejected through said ejection hole 11 of the nozzle 10 to produce a spray of water inside the cubicle.

In the illustrated example, the nozzle 10 has a substantially flat circular surface 10*a* of a size such as to entirely cover the annular rim 3 of the end body 2 visible on the outer wall of the cubicle.

The ejection hole 11 is situated at the centre of said circular surface 10*a*.

On just one side of the circular surface 10*a* a small hollow cylinder 10*b* extends, formed in a single piece with the circular surface 10*a*, provided with threading to allow the small cylinder 10*b* and, therefore, the nozzle 10 to be screwed in to the first portion 2*a* of the end body 2 with prior interposition of a suitable O-ring 12.

Indeed, the first cylindrical portion 2*a* of the end body 2 has a corresponding internal threading made in a hollow 13 suitable for receiving the small cylinder 10*b* of the nozzle 10.

Basically, the first portion 2*a* of the end body 2 is a hollow cylinder with an external threading and a threading inside the hollow 13.

Of course, the hollow 13 is in direct communication with the through channel 6.

In order to allow easy screwing and unscrewing of the nozzle 10 from the end body 2, the circular surface 10*a* of the nozzle 10 is provided, on the opposite side to where the small cylinder 10*b* is present, with a suitably shaped recess 14, in the example with a hexagonal section, to allow a tool to be used, such as an Allen wrench.

The recess 14 is formed at the ejection hole 11 that is thus arranged on the base of the recess 14. To eject the water from the nozzle 10 in nebulized or filiform form, an annular body 15, called a diffusing ring, is inserted inside the small hollow cylinder 10*b* of the nozzle 10.

In greater detail, the diffusing ring 15 is placed in abutment against the ejection hole 10 preferably with a spacer 10*c* placed in between having a small through channel 16 towards the ejection hole 11 itself. In the example, the spacer 10*c* is formed in a single piece with the nozzle 10, therefore, in FIG. 1 just the small channel 16 can easily be distinguished.

The ring surface 15 opposite the one in abutment has a plurality of grooves 17.

The shape and arrangement of the grooves on the annular surface of the ring 10 determine the type of water diffusion.

Figure 3:
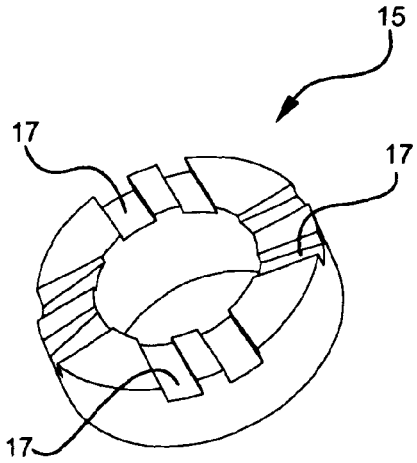
FIGS. 3 and 4 show a perspective view of a ring for the jet of FIG. 1, for filiform and nebulizing spray, respectively.
Figure 4:
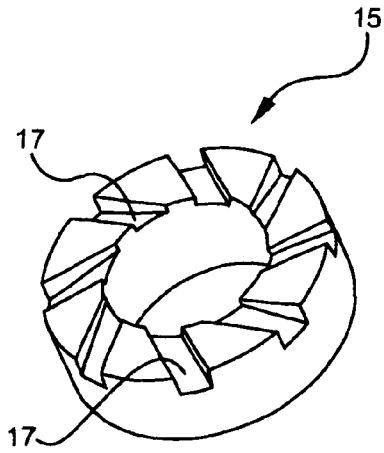

As an example, grooves 17 arranged radially in pairs describing a helix, as can be seen in FIG. 3, determine a filiform spray of water, whereas grooves 17 arranged radially one at a time at a constant distance, still describing a helix, as can be seen in FIG. 4, determine a nebulized-type spray.

So that the configuration of the ring 15 can effectively determine the type of flow, a pin 18 provided with a doughnut 19, the latter, in the example, integral with the pin 18, is inserted into the small cylinder 10*b* placing the doughnut 19 in abutment against the ring 15 at the part where the grooves 17 are present and the point of the pin 18 facing towards the small channel 16, as can be seen in FIG. 1.

The tail of the pin 18 is arranged inside the through channel 6 coaxially to it ands allows the possible turbulence due to the motion of the pressurised water coming from the pipes to be dampened.

To allow water to pass through the grooves 17, the doughnut 19 has a smaller circular perimeter than that of the ring 15 (FIG. 1). Therefore, to avoid the doughnut 19 and relative annexed pin 18 being able to undergo displacements due to the passage of pressurised water, the doughnut 19 is provided with tabs 20 arranged radially on its perimetric edge, in the example three in number arranged 120° apart.

The tabs 20, as well as preventing the radial movement of the doughnut 19 and of the pin 18, also prevents their axial movement through technical provisions known in the field, as can be seen in FIG. 1.

Basically, the water coming from the opening 5 arrives in the through channel 6 and to go out from the ejection hole 11 it is forced to cross the grooves 17 present on the diffusing ring 15. Should it be wished to change the type of spray generated by the jet 1, it is sufficient to simply replace the ring 15 present inside the nozzle 10.

As can be appreciated from that which has been described, the jet for a shower cubicle according to the present invention allows the requirements to be satisfied and allows the drawbacks mentioned in the introductive part of the present description with reference to the prior art to be overcome.

Indeed, the jet for a shower cubicle of the present invention allows the type of water spray ejected by the nozzle to be changed, as well as allowing a possible complete replacement of the nozzle to be carried out through the use of a simple Allen wrench.

Moreover, said jet for a shower cubicle is simple and cost-effective to manufacture.

Of course, a man skilled in the art can bring numerous modifications and variants to the jet for a shower cubicle described above in order to satisfy contingent and specific requirements, all of these modifications in any case being covered by the scope of protection of the invention, as defined by the following claims.

The invention claimed is:

1. A jet for a shower cubicle, suitable for being applied to a side wall of the shower cubicle, comprising:

an end body for supplying water to the shower cubicle having a through channel for the water, the end body being suitable for being fixed to the wall at an inlet hole for the water into the cubicle;

a fastener that can be associated with the end body to fix the end body to the wall of the cubicle at the inlet hole;

at least one supply duct for the water communicating with the through channel of the end body;

a nozzle provided with a water ejection hole, wherein a spacer is located in the water ejection hole, the spacer having a channel aligned with the through channel, the nozzle being in communication with the through channel, the pressurized water coming from the supply duct and crossing the through channel being ejected through the ejection hole of the nozzle to produce a water spray inside the cubicle, the nozzle being removable from the end body allowing it to be replaced, when the end body is fixed to the wall of the cubicle;

an annular body provided with grooves arranged inside the through channel in abutment against the nozzle, the grooves on a surface opposite the one in abutment against the nozzle; and a pin partially inserted inside the annular body, the pin being equipped with a doughnut arranged in abutment against the annular body to force the water to radially cross the grooves from a perimetric zone towards a centre, wherein the pin has a point which is directed toward the channel of the spacer, and a plurality of spacer tabs suitable for keeping the doughnut in a fixed position during the passage of the water are radially associated with the doughnut.

2. A jet according to claim 1, wherein the doughnut and the pin are manufactured in a single piece.

3. A jet according to claim 1, wherein the end body is manufactured in a single piece through injection moulding.

* * * * *